US007134249B2

(12) United States Patent
Shapiro et al.

(10) Patent No.: US 7,134,249 B2
(45) Date of Patent: Nov. 14, 2006

(54) CEILING PANEL

(75) Inventors: Gary Shapiro, Bradenton, FL (US); Scott Merry, Sarasota, FL (US); Jeffrey Bauman, Bradenton, FL (US)

(73) Assignee: American Metal Ceiling Panel Manufacturing, Inc., Bradenton, FL (US)

( * ) Notice: Subject to any disclaimer, the term of this patent is extended or adjusted under 35 U.S.C. 154(b) by 415 days.

(21) Appl. No.: 10/659,633

(22) Filed: Sep. 10, 2003

(65) Prior Publication Data

US 2005/0050822 A1 Mar. 10, 2005

(51) Int. Cl.
*E04F 13/00* (2006.01)
*E04F 15/00* (2006.01)
*E04F 19/00* (2006.01)

(52) U.S. Cl. ..... 52/311.2; 52/506.01; 52/591.1; 52/592.1; 52/539

(58) Field of Classification Search ..... 52/311.2, 52/316, 506.1, 506.09, 509, 506.06, 506.08, 52/588.1, 591.1, 591.4, 537–539, 546, 529–530, 52/555, 592.1; 403/291, 301, 339, 340, 381; D25/143, 140, 138, 147
See application file for complete search history.

(56) References Cited

U.S. PATENT DOCUMENTS 3,936,990 A 2/1976 Garrison, Jr. et al.
3,950,916 A 4/1976 Kasprzak
4,117,642 A 10/1978 Eckert et al.
4,251,972 A 2/1981 Interlante
4,267,679 A * 5/1981 Thompson ..... 52/588.1
4,407,104 A * 10/1983 Francis ..... 52/309.4
4,437,287 A 3/1984 Halfaker
4,480,360 A 11/1984 Brugman et al.
4,580,382 A 4/1986 Judkins et al.
4,599,831 A 7/1986 Magaha, Jr.
4,781,005 A 11/1988 Rijnders
4,858,409 A 8/1989 Handley et al.
4,884,383 A 12/1989 Rijnders
4,951,443 A 8/1990 Caferro
5,191,743 A 3/1993 Gailey
5,202,174 A 4/1993 Capaul
5,253,463 A 10/1993 Witmyer
5,293,728 A * 3/1994 Christopher et al. ..... 52/588.1
5,428,930 A 7/1995 Bagley et al.
5,438,810 A * 8/1995 Bullen et al. ..... 52/539
5,507,125 A 4/1996 McClure
5,535,566 A 7/1996 Wilson et al.
5,553,434 A * 9/1996 Tamura ..... 52/545
5,878,541 A 3/1999 Gruber
5,904,343 A * 5/1999 Parth ..... 256/24
5,968,287 A * 10/1999 Nath ..... 136/251
6,026,624 A * 2/2000 Patel et al. ..... 52/529
D421,897 S 3/2000 Washecheck et al.
6,079,177 A 6/2000 Halchuck
6,108,994 A 8/2000 Bodine
6,117,514 A * 9/2000 Herrmann ..... 428/81
6,155,764 A 12/2000 Russo
6,195,952 B1 * 3/2001 Culpepper et al. ..... 52/522
6,205,733 B1 3/2001 LaLonde (Continued)

*Primary Examiner*—Carl D. Friedman
*Assistant Examiner*—Chi Q. Nguyen
(74) *Attorney, Agent, or Firm*—Saile Ackerman LLC; Stephen B. Ackerman

(57) ABSTRACT

A panel, for installation on a ceiling as a component of a matrix grid of similar panels, with the ceiling panels capable of being installed directly on sheetrock ceilings without the otherwise need for affixing a wooden structure to the sheetrock ceiling before affixing the ceiling panels.

13 Claims, 4 Drawing Sheets

U.S. PATENT DOCUMENTS 6,230,463 B1 5/2001 Bodine
6,341,463 B1 * 1/2002 Dickey et al. ..... 52/521
6,351,921 B1 * 3/2002 Roberson ..... 52/521
6,467,228 B1 10/2002 Wendt et al.
6,499,262 B1 12/2002 Pinchot et al.

* cited by examiner

CEILING PANEL

STATEMENT REGARDING FEDERALLY SPONSORED RESEARCH OR DEVELOPMENT

Not Applicable

REFERENCE TO SEQUENCE LISTING, A TABLE OR A COMPUTER PROGRAM LISTING COMPACT DISK APPENDIX

Not Applicable

BACKGROUND OF INVENTION

The use of ceiling panels, particularly but not exclusively for decoration, is well known. Ceiling panels are typically composed of sheet metal with an embossed decorative pattern or of non-metallic material, such as asbestos or cellulose-like materials. The non-metallic ceiling panels have many deficiencies. Consequently metal ceiling panels, particularly those fabricated of tin, are preferred. However, the installation of metal ceiling panels presents challenges.

Most non-suspended ceilings are constructed of sheetrock. Traditionally metal ceiling panels have been installed, that is, affixed to the ceiling, by using nails at the corners or at the perimeter of each individual ceiling panel. However, due to the nature of the composition of sheetrock, nails cannot adequately affix metal ceiling panels to sheetrock due to the inability of nails to adequately grip and hold firmly to the sheetrock and the resultant tendency of the nails to slip-out of overhead sheetrock over a period of time, thereby releasing the panels from the ceiling, which of course is most undesirable.

Consequently, the traditional approach to installing metal ceiling panels to sheetrock ceilings is to first install a plywood surface over the entire sheetrock ceiling, and to then subsequently nail each of the metal ceiling panels into the thusly installed plywood. This is a labor intensive, time consuming and costly installation procedure.

An alternative but equally undesirable approach is to install wooden strips on the sheetrock ceiling, and to then nail each of the metal ceiling panels into the wood strips. With this approach, it is essential for the wood strips to be aligned very carefully to assure that the strips do in fact align with the edges of the panels as they are installed. Although easier than covering an entire sheetrock ceiling with plywood prior to installation of metal ceiling panels, this wooden strip approach is also still a very a labor intensive, time consuming and costly installation procedure.

In addition, metal ceiling panels traditionally have been installed by being placed side-by-side with each other, without any interlocking mechanism to attach adjoining ceiling panels to each other during the installation process, or indeed otherwise. Such interlocking of contiguous ceiling panels would both facilitate the installation process and would also enhance the structural integrity of the installed metal ceiling panel matrix grid.

The manual dexterity necessary to install ceiling panels overhead is tremendous; not only does the installer need to assure proper alignment of each panel, but that installer must simultaneously also hold and support the panel in an overhead position while handling nails and a hammer.

An objective of the present invention is to solve the aforesaid problems.

BRIEF SUMMARY OF THE INVENTION

A preferred embodiment of the invention is the interlocking capability and characteristics of two or more ceiling panels to be installed contiguously with each other, particularly when installed onto a sheetrock ceiling surface as depicted in FIGS. 1 through 6 hereof.

This invention addresses and solves the traditional challenges and problems encountered prior to this invention with the installation of metal ceiling panels by avoiding the costly and time consuming installation of plywood or wooden strips between the sheetrock ceiling and the metal ceiling panels to be attached to that sheetrock ceiling.

This invention further addresses and solves the traditional challenges and problems encountered prior to this invention by the installer having had to simultaneously hold the ceiling panel in place overhead during the installation process, also assuring proper positioning and alignment of each panel, while also handling the affixing nails and operating the hammer by which the nails were driven through the ceiling panel and into the underlying plywood or wood strips.

The present invention solves the foregoing problems. The resultant ability for a ceiling panel to be held in position during installation other than by being continually held in place by the hands of the installer while the installer is simultaneously juggling nails and hammer, coupled with the ability to install metal ceiling panels directly to a sheetrock ceiling without the otherwise need for plywood or wood strips, results in the installation of metal ceiling panels being appreciably less labor intensive, less time consuming and consequently less expensive than otherwise.

BRIEF DESCRIPTION OF THE DRAWINGS

The illustration of a preferred embodiment of the invention is shown on the accompanying drawings in which.

DETAILED DESCRIPTION OF THE INVENTION

One preferred embodiment of the invention is depicted as a metal ceiling panel in FIGS. 1 through 6 hereof, which provides the ability for the installation of a ceiling panel directly onto a sheetrock ceiling without the otherwise need for first installing a plywood surface or wood strips to the sheetrock ceiling.

This is accomplished through the combination of an interlocking mechanism within each ceiling panel by virtue of which immediately adjoining ceiling panels are reversibly and removably connected to each other prior to being affixed to the sheetrock ceiling in conjunction with other ceiling panels then being affixed to the sheetrock ceiling by screws inserted through holes in the flanges of the ceiling panels.

Figure 1:
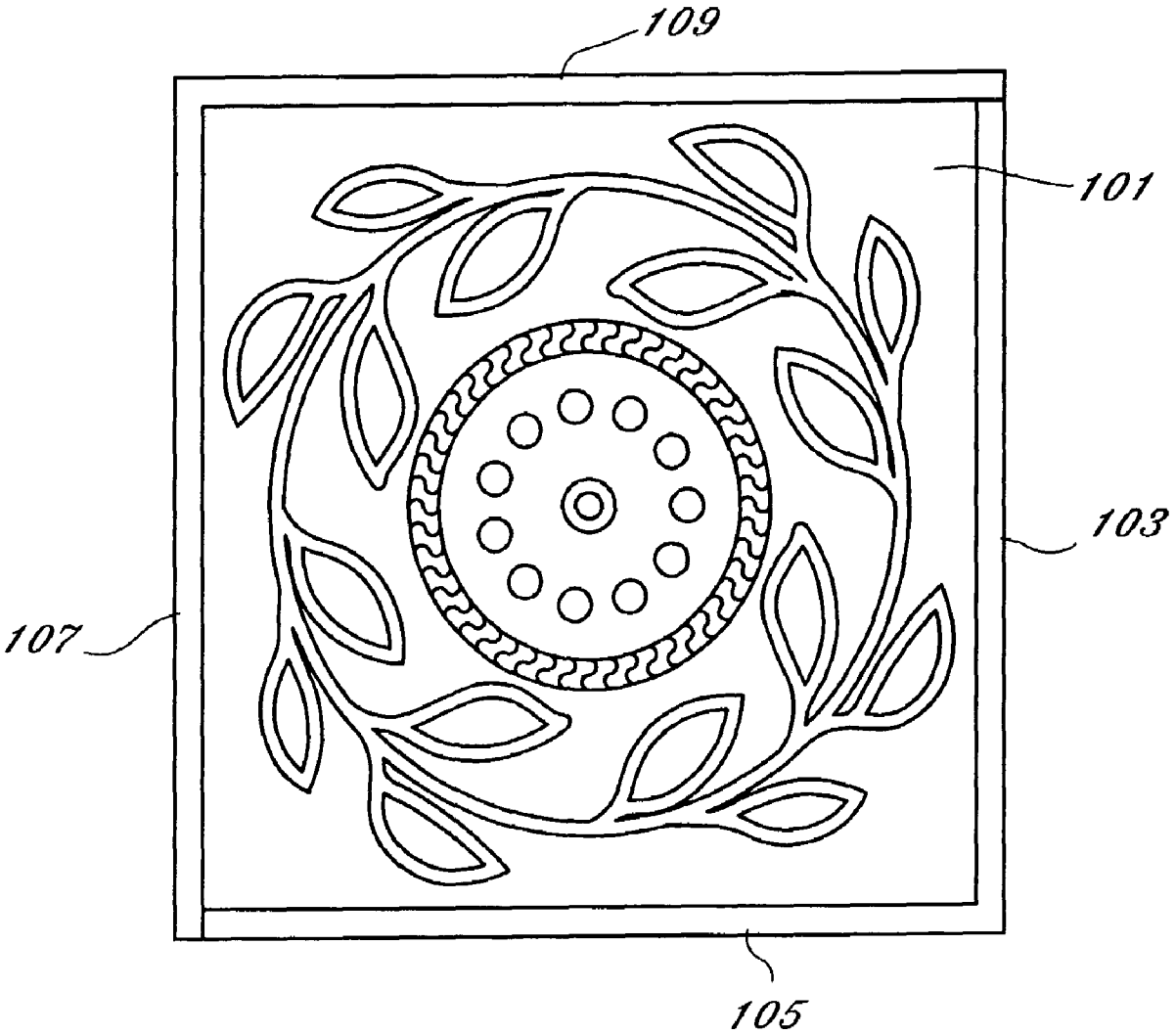
FIG. 1 is a view of the finished, embossed front face of a representation of a typical ceiling panel.

FIG. 1 is a view of the finished front face of a ceiling panel (101), in which there are four side edges shown as (103), (105), (107), and (109).

Figure 2:
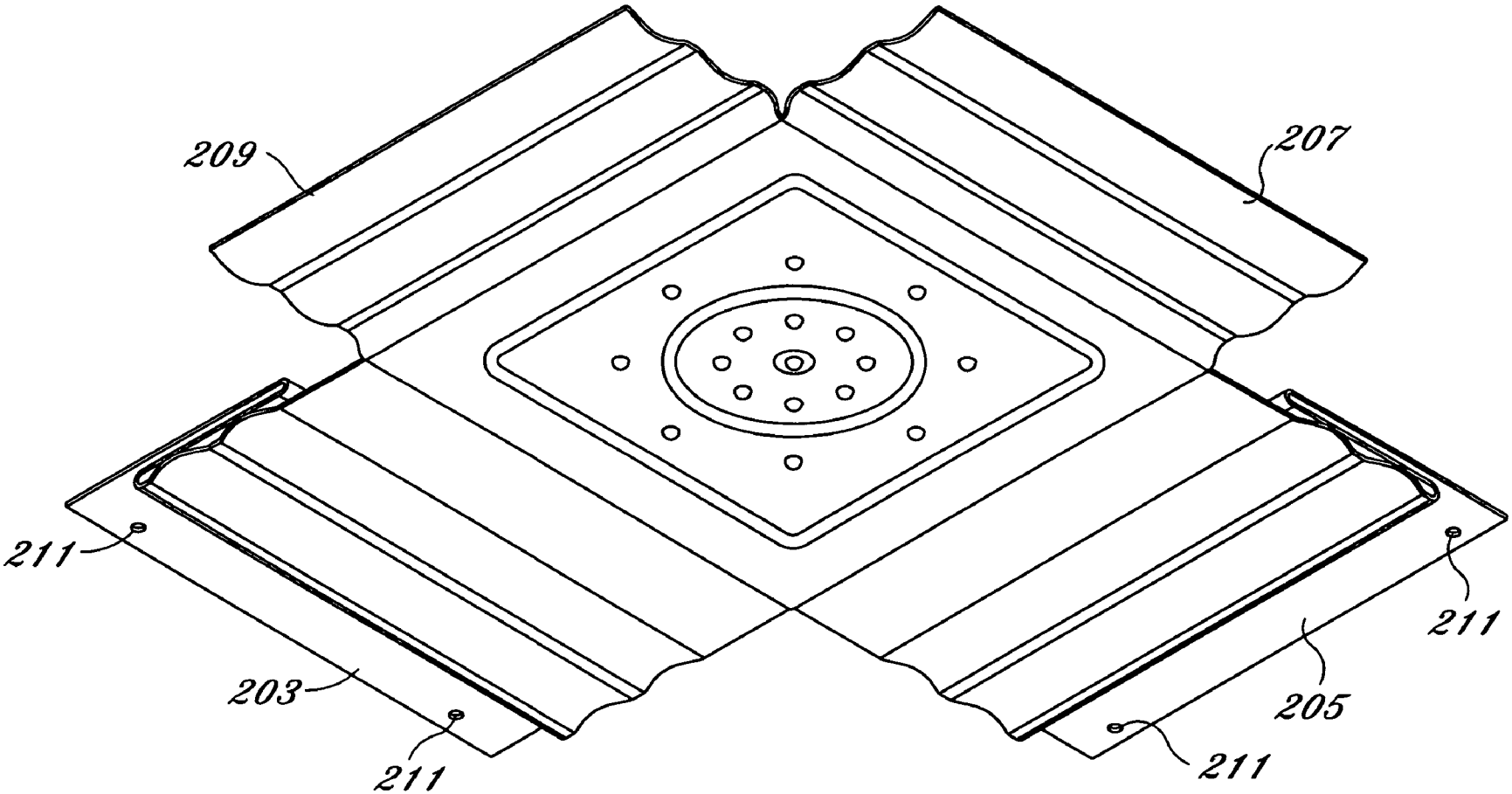
FIG. 2 is an isometric view of a ceiling panel, looking upward toward a ceiling on which the said ceiling panel is to be installed, simultaneously showing bottom and side perspectives.

FIG. 2 is an isometric view of the ceiling panel depicted in FIG. 1, but with the side edges which had been depicted in FIG. 1 as (103), (105), (107), and (109) now depicted for emphasis in a magnified, out-of-proportion depiction as (203), (205), (207), and (209).

Figure 3:
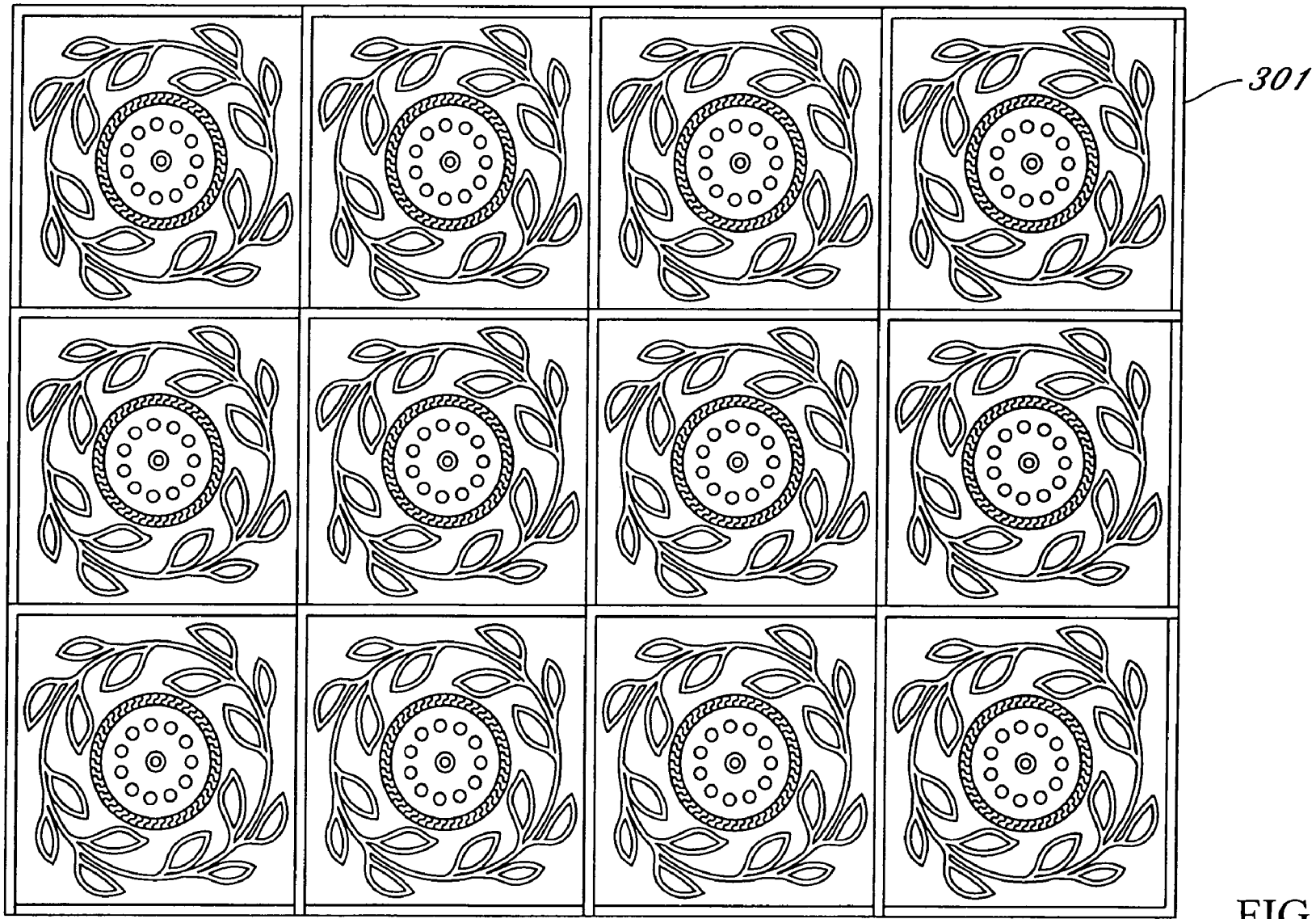
FIG. 3 is a depiction of a matrix grid of multiple ceiling panels installed on a ceiling.

FIG. 3 is a depiction of a matrix grid (310) comprised of twelve of the ceiling panels (101) depicted in FIG. 1. The use of twelve ceiling panels in this matrix grid is only for purposes of illustration, with the matrix grid actually being any number of ceiling panels configured in an interconnected matrix grid of such ceiling panels.

Figure 4:
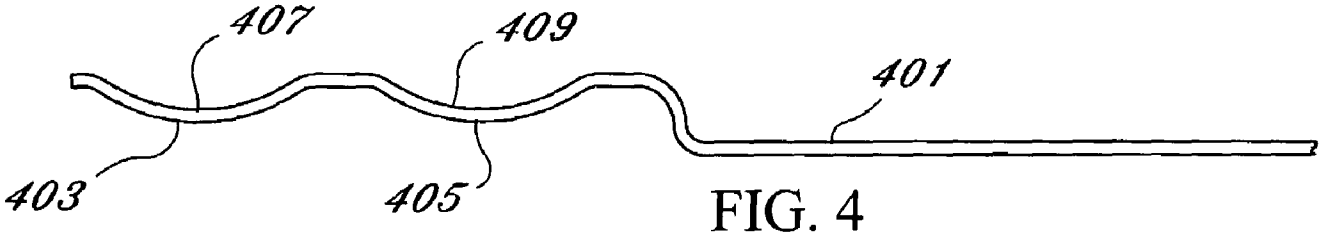
FIG. 4 is a cross-section of the male interlock component feature of the invention, not inserted into the female interlock component feature of the invention.

FIG. 4 depicts a cross-section of the male interlock component feature of the invention (401), in which there are both convex protrusions (403) and (405), and also resultant concave indentations (407) and (409) from the plane of the male interlock component feature of the invention (401).

The use of two such protrusions and two such indentations is only for purposes of illustration, with the actual number of such protrusions and indentations being one or more, but certainly not limited to two.

The surfaces of protrusions (403) and (405) can be either smooth or alternatively can be coated, treated or otherwise conditioned or textured to thereby increase the coefficient of friction between said surfaces (403) and (405) with the surfaces of any materials with which they are placed in contact, including the surface of the interior wall (511) of the female interlock component feature of the invention.

Similarly, the surfaces of indentations (407) and (409) can be either smooth or alternatively can be coated, treated or otherwise conditioned or textured to thereby increase the coefficient of friction between said surfaces (407) and (409) with the surfaces of any materials with which they are placed in contact, including the surfaces of protrusions (507) and (509) on the surface of the interior walls (511) of the female interlock component feature of the invention.

Figure 5:
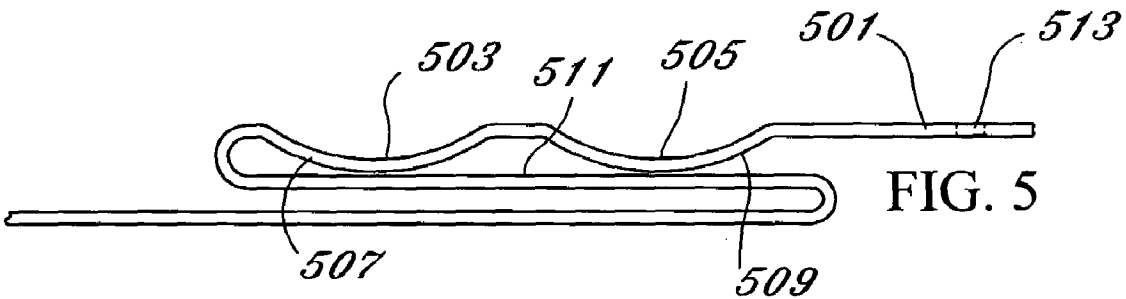
FIG. 5 is a cross-section of female interlock component feature of the invention, without the male interlock component feature of the invention inserted therein.

FIG. 5 depicts a cross-section of the female interlock component feature of the invention (501), in which there are both convex protrusions (507) and (509), and also resultant concave indentations (503) and (505) from the plane of the female interlock component feature of the invention (501).

FIG. 5 also depicts a relatively flat surface (511) facing and directly opposite to surfaces of protrusions (507) and (509).

In addition, FIG. 5 depicts a hole (513) through which a screw or other affixing means may be inserted to affix the ceiling panel, of which the female interlock component feature of the invention (501) is a part, onto a sheetrock ceiling.

The use of two such protrusions and two such indentations is only for purposes of illustration, with the actual number of such protrusions and indentations being one or more, but certainly not limited to two.

The surfaces of protrusions (507) and (509) can be either smooth or alternatively can be coated, treated or otherwise conditioned or textured to thereby increase the coefficient of friction between said surfaces (507) and (509) with the surfaces of any materials with which they are placed in contact, including the surfaces of indentations (407) and (405).

Figure 6:
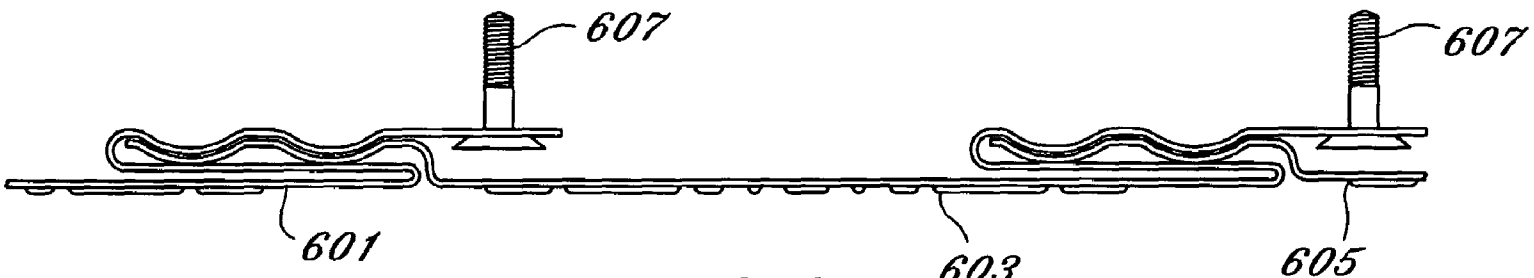
FIG. 6 is a cross-section of the male interlock component feature of the invention inserted into the female interlock component feature of the invention, showing a series of installed contiguous ceiling panels.

FIG. 6 depicts a cross-section of portions of two ceiling panels (601) and (605), each of which is connected to an entire ceiling panel (603).

Each ceiling panel in that preferred embodiment depicted in the FIGS. 1 through 6 hereof has two male side edges (207) and (209) and two female side edges (203) and (205). One or more holes (211) exist in each flange portion of the said female side edges (203) and (205) to allow for the insertion of a screw or other affixing means by which the ceiling panel is affixed to a sheetrock ceiling.

In the installation process, the said male side edges (207) and (209) are inserted into the female side edges (203) and (205), respectively. The said ceiling panels, when thusly connected with each other, interlock in a "snap-lock" fashion, thereby self-aligning themselves with other ceiling panels previously installed in the matrix grid (301) and providing a means for the ceiling panels subsequently installed to be similarly self-aligned.

In addition, once so connected and interlocked the said ceiling panels are relatively self-supporting, and need no longer be held in the hands of the installer. Consequently, the installer then has both of his hands free to use for holding nails, screws, hammers, screw drivers or any other tools used to affix the ceiling panel matrix grid to the sheetrock ceiling.

As the male interlock component feature of the invention as depicted in FIG. 4 is inserted into the female interlock component of the invention as depicted in FIG. 5, (as shown fully inserted in FIG. 6), surfaces (407) and (403) are initially placed in contact with surfaces (509) and (511), respectively, and as the insertion continues, those surfaces (407) and (403) are then and finally placed in contact with surfaces (507) and (511), respectively, while simultaneously surfaces (409) and (405) are then and finally placed in contact with surfaces (509) and (511), respectively.

During and in the course of the aforementioned insertion procedure, the said protrusions and indentations of the said male interlock component feature of the invention (401) and the said protrusions an indentations of the said female interlock component feature of the invention (501) are temporarily plastically flexibly displaced or deformed, or both, to thereby allow for the said insertion, after which insertion the said protrusions and indentations return to their original shapes and forms.

Upon completion of the said insertion procedure, there is a resulting secure interlock between the two adjacent ceiling panels thus connected. Notwithstanding the said interlock, the said connected ceiling panels are still forcibly separable by applying sufficient force to one ceiling panel in a direction which is opposite to that simultaneously applied to the other then connected second ceiling panel.

Each ceiling panel (101) in the matrix grid (301) is affixed to the ceiling by means of screws (607) inserted through screw holes (513).

It is contemplated that the inventive concepts herein described may be variously otherwise embodied and it is intended that the appended claims be construed to include alternative embodiments of the invention except only insofar as limited by prior art.

The invention claimed is:

1. A panel constructed of a material for installation on a ceiling as a component of a matrix grid of multiple said panels, with each said panel comprising:

two side edges of each said panel having a flange extension along at least a portion of the length of said side edge;

said side edge of said panel which immediately adjoins said flange extension having a female interlock component along at least a portion of the length of said side edge;

the interior of said female interlock component having two opposing interior surfaces, one of which is a flat interior surface and the other of which has one or more protrusions, with said protrusions directed toward said flat interior surface;

each side edge of said panel not having said flange extension and not having said female interlock component having instead a male interlock component; and said protrusions on said interior wall of said female interlock component being configured and positioned to mesh with and interface with the male interlock component upon the male interlock component being inserted into said female interlock component.

2. A panel constructed of material for installation on a ceiling as a component of a matrix grid of multiple said panels, with each said panel comprising:

two side edges of each said panel having a flange extension along at least a portion of the length of said side edge;

said side edge of said panel which immediately adjoins said flange extension having a female interlock component along the length of said side edge;

the interior of said female interlock component having two opposing surfaces, one of which is flat and the other of which has one or more convex protrusions, with said protrusions directed toward said flat interior surface;

each side edge of said panel not having said flange extension and not having said female interlock component having instead a male interlock component;

said convex protrusions on said interior wall of said female interlock component being configured and positioned to mesh with and interface with the male interlock component upon the male interlock component being inserted into said female interlock component.

3. A panel constructed of material for installation on a ceiling as a component of a matrix grid of multiple said panels, with each said panel comprising:

two side edges of each said panel having a flange extension along at least a portion of the length of said side edge;

said side edge of said panel which immediately adjoins said flange extension having a female interlock component along the length of said side edge;

the interior of said female interlock component having two opposing surfaces, one of which is flat and the other of which has one or more convex protrusions, with said protrusions directed toward said flat interior surface;

said convex protrusions being capable of being temporarily plastically flexibly displaced or deformed, or both;

each side edge of said panel not having said flange extension and not having said female interlock component having instead a male interlock component;

said male interlock component having on its surface one or more protrusions and corresponding indentations;

said convex protrusions on the said male interlock component being capable of being temporarily plastically flexibly displaced or deformed, or both;

said convex protrusions on said interior wall of said female interlock component being configured and positioned to mesh with and interface with the corresponding protrusions and corresponding indentations on said male interlock component upon the male interlock component being inserted into said female interlock component;

each said flange extension extending for a minimum width from said side edge of said panel a distance at least as wide as the diameter of the head of a screw by which said panel can be affixed to a ceiling; and each said flange extension having at least one hole through which a screw for affixing the said panel to said ceiling can be inserted.

4. The panel of claim 1 wherein said surface of any said protrusion is coated, treated or otherwise conditioned or textured to thereby increase the coefficiency of friction between said surface and any other surface with which it is in contact.

5. The panel of claim 2 wherein said surface of any said protrusion is coated, treated or otherwise conditioned or textured to thereby increase the coefficiency of friction between said surface and any other surface with which it is in contact.

6. The panel of claim 3 wherein said surface of any said protrusion is coated, treated or otherwise conditioned or textured to thereby increase the coefficiency of friction between said surface and any other surface with which it is in contact.

7. A flat panel constructed of thin sheet metal material for installation on a ceiling as a component of a matrix grid of multiple said panels, with each said panel comprising:

two side edges of each said panel, and located on two contiguous side edges of said panel, having a flange extension along at least a portion of the length of said side edge;

said side edge of said panel which immediately adjoins said flange having a female interlock component along at least a portion of the length of said side edge for insertion of a male interlock component in the course of installation of a ceiling;

the interior of said female interlock component having two opposing interior surfaces, one of which is flat and the other of which has one or more protrusions, with said protrusions directed toward said flat interior surface;

each said protrusion of the female interlock component being perpendicular to the plane of said interior surface;

each side edge of said panel not having said flange extension and not having said female interlock component having instead a male interlock component;

said male interlock component having on its surface one or more protrusions perpendicular to the plane of said surface; and said protrusions on said interior wall of said female interlock component being configured and positioned to mesh with and interface with the corresponding protrusions on said male interlock component upon the male interlock component being inserted into said female interlock component.

8. A flat panel constructed of sheet metal material for installation on,a ceiling as a component of a matrix grid of multiple said panels, with each said panel comprising:

two side edges of each said panel, located on two contiguous side edges of said panel, having a flange extension along at least a portion of the length of said side edge;

said side edge of said panel which immediately adjoins said flange having a female interlock component along at least a portion of the length of said side edge for insertion of a male extension in the course of installation of a ceiling;

the interior of said female interlock component having two opposing interior surfaces, one of which is flat and the other of which has one or more protrusions, with said protrusions directed toward said flat interior surface;

each said protrusion being perpendicular to the plane of said interior surface;

each side edge of said panel not having said flange extension and not having said female interlock component having instead a male interlock component;

said male interlock component having on it's surface one or more protrusions perpendicular to the plane of said surface;

said protrusions on said interior wall of said female interlock component being configured and positioned to mesh with and interface with the corresponding protrusions on said male interlock component upon the male interlock component being inserted into said female interlock component;

each said flange extension extending for a minimum width from said side edge of said panel a distance at least as wide as the diameter of the head of a screw by which said panel can be affixed to a ceiling; and each said flange extension having at least one hole through which a screw for affixing the said panel to said ceiling can be inserted.

9. The flat panel of claim 7 wherein said surface of any said protrusion is coated, treated or otherwise conditioned or textured to thereby increase the coefficiency of friction between said surface and any other surface with which it is in contact.

10. The flat panel of claim 8 wherein said surface of any said protrusion is coated, treated or otherwise conditioned or textured to thereby increase the coefficiency of friction between said surface and any other surface with which it is in contact.

11. A method for installation of ceiling panels, wherein each of said ceiling panels includes two female interlock component female side edges and two male interlock component side edges, with said female interlock component side edge also having a flange extending away from said ceiling panel, with said flange having at least one hole, comprising:

inserting a male interlock component side edge of a first ceiling panel into a female interlock component side edge of an adjacent second ceiling panel, whereby said first panel and said second panel are interlocked with each other;

placing said first ceiling panel in direct contact with an overhead ceiling;

inserting one or more sheetrock screws through said hole or holes in said flange on the female interlock component side edge of said first ceiling panel; and rotating the said sheetrock screws into a sheetrock material to hold the first panel to the ceiling and preventing the second panel from falling while attaching the second panel to the sheetrock material.

12. A method for installation of ceiling panels directly to a sheetrock ceiling, wherein each of said ceiling panels includes at two female interlock component side edges and two male side edges, with said female interlock component side edge also having a flange extending away from said ceiling panel, with said flange having at least one hole, comprising:

inserting a male interlock component side edge of a first ceiling panel into the female interlock component side edge of an adjacent second ceiling panel which has already been affixed to said ceiling, whereby said first panel and said second panel are interlocked with each other, said first panel is held in position near said ceiling and prevented from falling by said male and female interlock components;

placing the said first ceiling panel in contact with an overhead sheetrock ceiling;

inserting one or more sheetrock screws through said hole or holes in said flange on the female interlock component side edge of the said first ceiling panel; and rotating the said sheetrock screws into said sheetrock.

13. The method of claim 12, wherein said male edge is a male interlock component side edge.

* * * * *